United States Patent [19]

Rundzaitis

[11] 4,165,837

[45] Aug. 28, 1979

[54] POWER CONTROLLING APPARATUS IN A SHOWERHEAD

[75] Inventor: Alfons Rundzaitis, Beverly Shores, Ind.

[73] Assignee: Associated Mills, Inc., Chicago, Ill.

[21] Appl. No.: 891,608

[22] Filed: Mar. 30, 1978

[51] Int. Cl.[2] ..... B05B 1/08

[52] U.S. Cl. ..... 239/394; 239/449; 239/443

[58] Field of Search ..... 239/394, 443, 417.3, 239/541, 436, 445, 483, 449, 562, 101, 446, 381; 128/66

[56] References Cited

U.S. PATENT DOCUMENTS

| | | | |
|---|---|---|---|
| 3,545,681 | 12/1970 | Crist | 239/449 |
| 3,876,151 | 4/1975 | Katua | 239/443 |

*Primary Examiner*—James B. Marbert

*Attorney, Agent, or Firm*—Allegretti, Newitt, Witcoff & McAndrews

[57] ABSTRACT

An improvement of a power controlling apparatus is included in a showerhead.

5 Claims, 6 Drawing Figures

POWER CONTROLLING APPARATUS IN A SHOWERHEAD

BACKGROUND OF THE INVENTION

The present invention relates to an improvement in a hand-held showerhead for use in a bathroom shower and the like, and more particularly, to an improvement in a hand-held showerhead of water controlling apparatus that permits the user to select the strength at which water is discharged from said showerhead.

In the past, a variety of different types of wall mounted and hand-held showerheads have been disclosed. One type of hand-held showerhead is disclosed and claimed in U.S. Pat. No. 3,998,390 entitled "Selectable Multiple Showerhead" and issued Dec. 21, 1976, to Samuel F. Peterson et. al. The present invention is an improvement in the type of hand-held showerhead disclosed in the Peterson patent.

As disclosed in Column 12, lines 9–14, of the Peterson et. al. patent, inherent in the showerhead disclosed therein is a mechanism for varying the volume of water discharged from the showerhead. While this mechanism is highly useful, the mechanism must be operated with the use of both hands of the user and provides no positive limitation on the range of volume variations. That is, the user must hold the hand-held showerhead in one hand and adjust the dial assembly with the other. Unless the user is attentive to the position of the dial assembly, he or she may, while attempting to vary the spray, rotate the dial assembly too far, thereby stopping the flow from the showerhead. The mechanism is thus somewhat inconvenient and may detract from the satisfaction the user derives from the showerhead.

SUMMARY OF THE INVENTION

It is a primary object of the present invention to provide an improvement of a water controlling apparatus in a hand-held showerhead that is adapted for use in bathroom showers and the like, which, because of the simplicity of the design structure thereof, does not significantly increase the relatively inexpensive manufacturing cost of the showerhead.

Another object of the present invention is to provide the improvement of a water controlling apparatus in a showerhead wherein the apparatus provides and indicates a plurality or range of water strength and wherein the user may select the particular water strength to be utilized and may readily change from utilizing one water strength to another while the water is running.

Still another object of the present invention is to provide an improvement of a water controlling apparatus in a showerhead wherein the user may select the particular water strength to be utilized and may change from utilizing one water strength to another with the use of one hand only, i.e., the hand with which the user holds the showerhead.

Thus in a principal aspect, the present invention is an improvement of a water controlling apparatus in a hand-held showerhead.

The showerhead has a handle-housing including a main body and an integral handle which extends from the body. The main body has a cylindrical chamber wall and a backwall, the chamber wall defining a cylindrical chamber, the chamber having an open front portion and a rear portion. The handle defines a conduit through which water may flow with an upper end in communication with the rear portion of the chamber.

The water controlling apparatus includes a projecting portion of the main body rearward of the chamber. The projecting portion defines an opening through the back surface of the main body of the housing into the chamber.

A valve member having a cylindrical valve portion positioned within the chamber and an integral post portion extending through the opening defines a channel for opening the upper end of the conduit to the front portion of the chamber. The valve member is rotatable so as to rotate the channel into and away from registry with the conduit.

A control knob which includes a body portion, an integral lever portion and an integral indicator portion is fastened to the post portion of the valve member adjacent the projecting portion of the main body for rotation with the post portion. The lever portion extends from the body portion and is adapted to be rotated by hand. The indicator portion also extends from the body portion.

Indicia on the backwall of the housing cooperate with the indicator portion of the control knob to indicate the strength of the flow exiting the showerhead. The indicia indicate at least a first strength of water flow when the channel is substantially in registry with the conduit and a maximum quantity of water is flowing therethrough. The indicia also indicate at least a second strength of flow exiting the showerhead when the channel is substantially away from registry with the conduit and a lesser quantity of water than the maximum flow through the channel.

Figure 2:
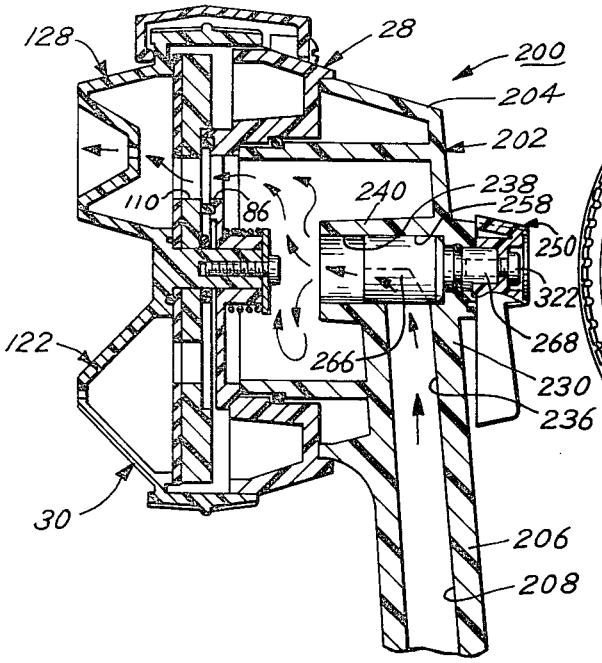
FIG. 2 is a partial, cross-sectional view taken along line 2—2 in FIG. 1.

Throughout the various figures of the drawings, the same reference numerals will be used to designate the same parts of components in the improved showerhead of the present invention. Moreover, when the terms "front" and "rear" and variations of those terms are used herein it is to be understood that these terms have reference to the structure shown in the drawing as would appear to a person viewing the drawing and as the improved showerhead is normally used.

DETAILED DESCRIPTION OF THE PREFERRED EMBODIMENT

Incorporated herein by reference, pursuant to M.P.E.P. 608.01(p), is U.S. Pat. No. 3,998,390, entitled "Selectable Multiple-Novel Showerhead", issued Dec. 21, 1976 to Samuel F. Peterson et. al. and commonly owned with the present invention. It should be understood that the complete detailed description of the preferred embodiment of the Peterson et. al. patent, as it relates to a hand-held showerhead, is intended to be incorporated herein. Thus, as an aid to clarity, throughout the present description and the various figures of the accompanying drawing the same reference numerals will be used to designate the same parts and/or components as are used in the Peterson et. al. patent.

Figure 1:
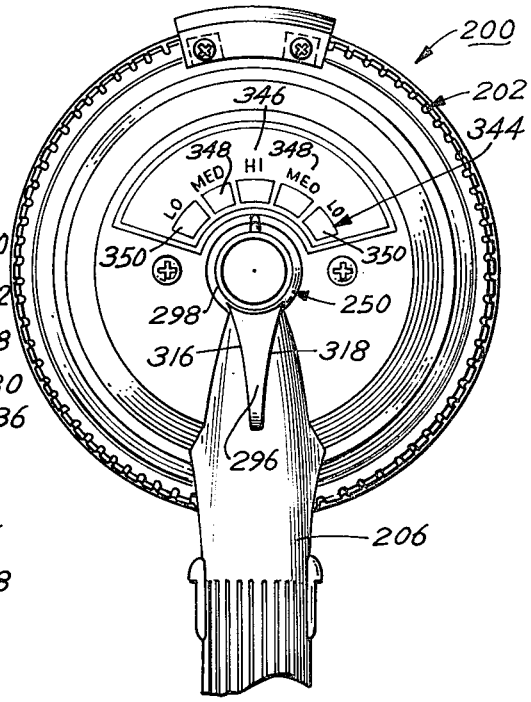
FIG. 1 is a partial, rear elevational view of a showerhead including the preferred embodiment of the improvement of the present invention.

Accordingly, with reference to FIGS. 1 and 2 of the accompanying drawing, the showerhead which includes the preferred embodiment of the present invention is shown and generally designated 200. As stated in the Peterson et. al. patent, the showerhead 200 includes a handle-housing 202, a disc member 28 and a dial assembly 30. The handle-housing 202 includes a main body 204 and an integral handle 206 which extends from the main body 204 at an angle to the central axis of the disc member 28 and the dial assembly 30. A conduit 208 is formed in the handle 206 and extends from the lower distal end thereof (not shown) to the upper end adjacent the main body 204. The upper end 236 of the conduit 208 communicates with a rear portion 258 of a cylindrical chamber 238 which is defined by a cylindrical wall 240 in the main body 204 and whose central axis is co-axial with the central axis of the disc member 38. The front end of the chamber 238 is open so that water flowing through the conduit 208, and into the chamber 238, may then flow through the first aperture 86 and an aligned nozzle aperture 110 and out the associated spray nozzle 122–128.

Figure 6:
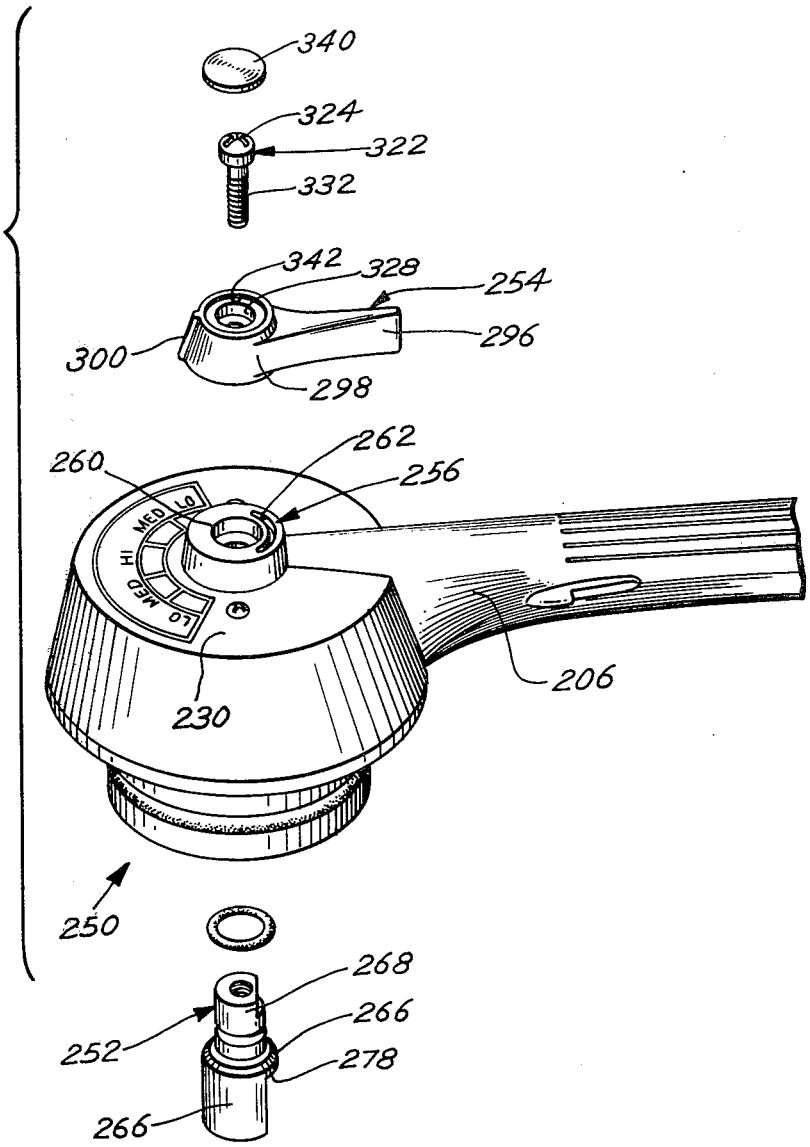
FIG. 6 is an exploded, perspective view of the preferred embodiment of FIG. 1.

However, rather than having a solid, smooth back wall 230 and a chamber 238 free of parts of components, as in the Peterson et. al. patent, the showerhead 200 of the preferred embodiment of the present invention includes a power controlling apparatus or assembly 250. As best shown in FIG. 6 of the accompanying drawing, the power control assembly 250 includes a valve member 252, a control knob or lever 254 and a rearwardly projecting, generally cylindrical portion 256 integrally formed on the handle-housing 202, which are connected to one another when in use.

The portion 256 extends from the rear portion 258 of the chamber 238 and defines a circular opening 260 which is co-axial with the chamber 238. An arcuate slot 262, which follows the curve of a circle having its center along the axis of the opening 260, is formed on the rear surface 264 of the portion 256.

Figure 3:
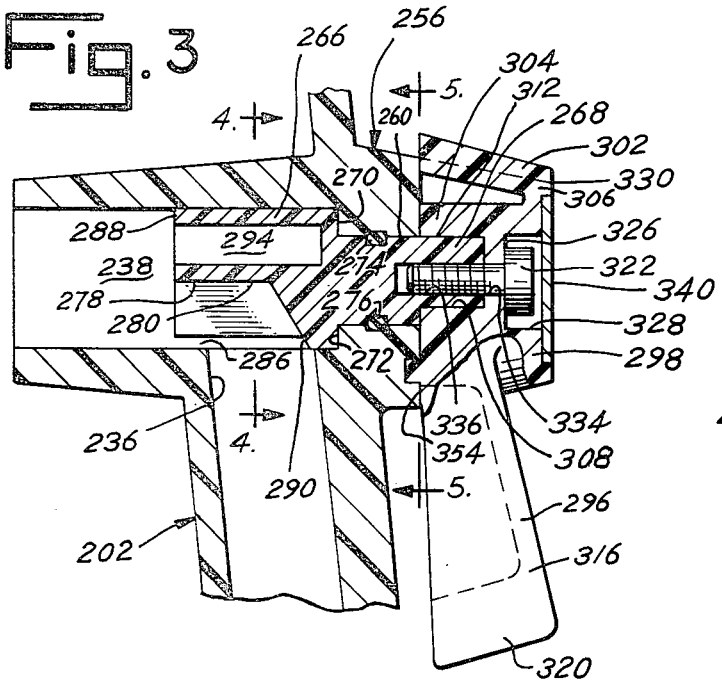
FIG. 3 is an enlarged, partial, cross-sectional view taken along the line 3—3 in FIG. 1.

As shown in FIGS. 3 and 6, the valve member 252 includes a first, generally cylindrical valve portion 266 and a second, generally cylindrical post portion 268. The central axes of the valve portion 266 and the post portion 268 are co-axial. The valve portion 266 has an outer diameter substantially equal to the inner diameter of the chamber 238, and the post portion 268 has an outer diameter substantially equal to the inner diameter of the opening 260. When positioned for use, the back surface 270 of the valve portion 266 abuts the front surface 272 of the portion 256, and the post portion 268 extends through the opening 260. A conventional O-ring 274 is positioned in an outwardly opening, annular recess 276 formed in the post portion 268, and provides a seal between the post portion 268 and the opening 260.

Figure 4:
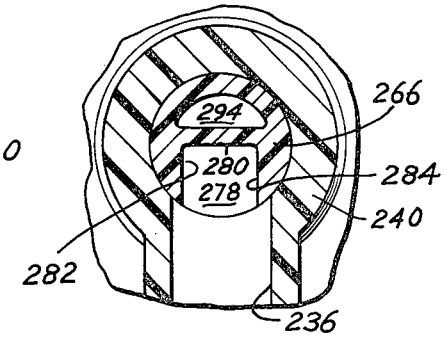
FIG. 4 is a partial, cross-sectional view taken along the line 4—4 in FIG. 3.

Defined within the valve portion 266 is a valve channel 278. As shown in FIG. 4, the valve channel 278 is substantially rectangular in cross-section, with an inner surface 280 along a diameter of the valve portion 266 defining the inner edge thereof, and with two side surfaces 282,284 defining the sides thereof. Equally spaced from the central axis of the valve portion 266, the side surfaces 282,284 are perpendicular to the inner surface 280. Along the lower or outer edge of the channel 278, the sidewall 286 of the valve portion 266 is cut away. The width of the channel between the side surfaces 282,284 is less than the diameter of the conduit 208.

As shown in FIG. 3, the valve channel 278 is open to the forward surface 288 of the valve portion 266. In the rotational position of the valve member 252 shown in FIGS. 3 and 4, the channel 278 is also open to the conduit 208. A generally planar, forwardly slanting surface 290 of the valve portion 266, which at the juncture 292 of the surface 290 and the sidewall 286 meets the most rearward point of the conduit 208, defines the back of the channel 278 and directs water flowing up the conduit 208 forward into the chamber 238.

Also defined within the valve portion 266 is a recess 294, which reduces the quantity of material needed to cast the valve member 252, thereby improving the economy of production.

Location of the valve member 252 controls the power with which the water exits the showerhead 200. That is, the valve member 252 is rotatable about its central axis within the chamber 238. In the rotational position shown in FIGS. 2, 3, and 4, the channel 278 is open from side surface 282 to side surface 284 to the conduit 208. Water thus flows through the full width defined between the side surfaces 282, 284. However, when the valve member 252 is rotated in either the clockwise or counter clockwise direction from the position shown, a portion of the width between the side surfaces 282,284 is blocked against the wall 240 of the chamber 238. The area open to the flow of water from the conduit 208 into the chamber 238 is thus decreased, in relation to the arc through which the valve member 252 is rotated. Thus the flow of water into the chamber 238 and the power of the water exiting the showerhead 200 is controlled.

To provide for facile rotation of the valve member 252, the control lever 254 includes a lever portion 296 along with an integrally formed body portion 298 and an integrally formed indicator portion 300. The body portion 298 includes an outer wall 302 with the shape of a truncated cone, and an inner wall 304 that is generally cylindrical and extends from a back wall 306 of the body portion 298.

Figure 5:
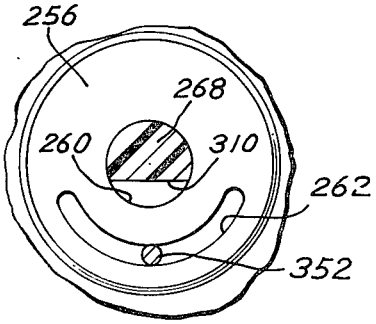
FIG. 5 is a partial, cross-sectional view taken along the line 5—5 in FIG. 3.

A generally cylindrical recess 308 is defined within the inner wall 304 to receive the section of the post portion 268 that extends rearward past the rear surface 264 of the portion 256. As best shown in FIG. 5, cut along the post portion 268 is a planar face 310 which is perpendicular to a radial line extending through the central axis of the valve member 252. A mating face 312 is defined along the recess 308 so that rotation of the body portion 298 about the central axis thereof results in rotation of the valve member 252 about its central axis.

To reduce the force needed to rotate the body portion 298, the lever portion 296 extends outward therefrom to provide a lever arm for the application of force thereto. As shown in FIGS. 1 and 3, the lever portion 296 has sides 316,318 which are slightly concave, and as shown in FIG. 3, the lever portion 296 is tapered from the tip 320 thereof to the body portion 298. The lever portion 296 thus has a pleasing appearance, and the tip 320 thereof provides a broad surface for the finger or thumb of the user.

As shown in FIGS. 2 and 3, the control lever 254 is fastened to the valve member 252 by a screw 322. The head 324 of the screw 322 rests against a transverse surface 326 defined by a first counterbore 328 in the rear surface 330 of the body portion 298. The body 332 of the screw 322 extends through an opening 334 in the surface 326 into a counterbore 336 in the post portion 268 of the valve member 252. The head 324 is covered to provide a pleasing appearance by a circular plug 340 glued in a second counterbore 342 in the rear surface 330.

An indication of the position of the valve member 252 and thus of the power of water exiting the showerhead 200 is presented to the user through the cooperation of the indicator portion 300 and indicia on the back surface 230 of the main body 204. As shown in FIG. 1, the indicia most preferred includes an arcuate scale 344. Included in the scale 344 are a section 346 labelled "HI," two sections 348 on either side of the section 346 labelled "MEDIUM," and two sections 350 adjacent the sections 348 labelled "LO". When the valve member 252 is in the position shown in FIGS. 3 and 4, the indicator portion 300 points to the section 346 of the scale 344. When the control lever 254 is utilized to rotate the valve member 252 away from the position of FIGS. 3–4, the indicator portion 300 points to either a section 348 or a section 350. As shown in FIG. 5, rotation of the control lever 254 past the rotational position in which the indicator portion 300 points to a section 350 is prevented by a tab 352 which extends from the forward surface 354 of the control lever 254 into the slot 262. When the tab 352 reaches either end of the slot 262, further rotation of the control lever 254 is prevented.

From the foregoing, it should be apparent to those having skill in the art that the typical user may use the showerhead 200 by simply turning on a conventional faucet so that water will flow into the conduit 208. The user may then rotate the dial assembly 30 about its central axis so as to select the spray nozzle 122–128 through which water will be discharged. Moreover, if so desired, the user may reduce or increase the power of the water existing in the showerhead 200 by positioning the control lever 254 as desired, with the thumb of the hand holding the showerhead.

The commercial advantage of molding the principal components of the showerhead 200 from plastic materials using conventional molding techniques, as emphasized in the Peterson et. al. patent, is retained by the present invention. All the principal components of the power control assembly 250, e.g., the valve member 252, the control lever 254 and the portion 256 of the handle-housing 202 may be so molded. The cost of manufacturing these components is thus minimized, and, therefore, the overall cost of a showerhead 200 which includes a power control assembly 250 remains only slightly above the overall cost of a showerhead molded in accordance with the Peterson et. al. patent.

In view of the foregoing, it should be apparent to a person having average skill in the art, that the showerhead 200 and the power controlling assembly 250 could be modified or changed without departing from the principals of the present invention. Thus, since the present invention as disclosed herein may be embodied in other specific forms without departing from the spirit or central characteristics thereof, the preferred embodiment described herein is to be considered in all respects as illustrative and not restrictive. The scope of the invention is indicated by the appended claims, rather than the foregoing description, and all changes which come within the meaning and range of equivalency of the claims are intended to be embraced therein.

What I claim is:

1. An improvement of a water controlling apparatus in a hand-held showerhead, the showerhead having a handle-housing including a main body and an integral handle which extends from said main body, the main body having a cylindrical chamber wall and a back wall, the chamber wall defining a cylindrical chamber, the chamber having an open front portion and a rear portion, the handle defining a conduit through which water may flow with an upper end in communication with the rear portion of said chamber, the water controlling apparatus comprising, in combination:

a projecting portion of said main body rearward of said chamber defining an opening through said back wall into said chamber;

a valve member having a cylindrical valve portion positioned within said chamber and an integral post portion extending through said opening, said valve portion defining a channel for opening said upper end of said conduit to said front portion of said chamber, said valve portion and said post portion co-axially aligned, said valve member rotatable so as to rotate said channel into and away from registry with said conduit;

a control knob including a body portion, an integral lever portion and an integral indicator portion, said body portion fastened to said post portion of said valve member adjacent said projecting portion for rotation with said valve member, said lever portion extending from said body portion and adapted to be rotated manually, said indicator portion extending from said body portion; and indicia on said back wall of said main body of said handle-housing, said indicia cooperating with said indicator portion of said control knob to indicate the strength of said flow, said indicia indicating at least a first strength when said channel is substantially in registry with said conduit and a second strength when said channel is substantially away from registry with said conduit.

2. A water controlling apparatus as claimed in claim 1 wherein said channel is defined by an inner surface, a first side surface, a second side surface and a back surface within said valve portion, said inner surface substantially parallel to a diameter of said valve portion, said first side surface and said second side surface substantially perpendicular to said inner surface and said back surface slanted forward toward said inner surface.

3. A valve controlling apparatus as claimed in claim 1 wherein said projecting portion of said main body has a back surface and said body portion of said control knob includes a front surface, an arcuate slot being defined within said back surface of said projecting portion and a cooperating tab projecting into said slot being defined on said front surface of said body portion whereby the location of said control knob and thereby said valve member is limited within a range defined by the arcuate length of said slot.

4. A water controlling apparatus as claimed in claim 1 wherein said indicia indicates said first strength, and indicates said second strength when said channel is rotated in either rotational direction a preselected rotational distance from the position in which said channel is substantially in registry with said conduit and further indicating a third strength when said channel is rotated in either rotational direction a second preselected rotational distance from the rotational position in which said channel is substantially in registry with said conduit.

5. A water controlling apparatus as claimed in claim 1 wherein said post portion has an axially extending planar face defined thereon and said body portion includes a cylindrical wall portion defining a generally cylindrical recess having a diameter substantially equal to the diameter of said post portion and defining an axially extending, mating planar face within said recess for cooperating with said planar face on said post portion for preventing relative rotation between said control knob and said valve member, said apparatus further comprising a fastener for fastening said main body against said post portion.

* * * * *